US007107651B1

(12) United States Patent
Lin

(10) Patent No.: US 7,107,651 B1
(45) Date of Patent: Sep. 19, 2006

(54) HANDLE APPLIED IN BATHROOM

(75) Inventor: Ching-Yi Lin, Changhua Hsien (TW)

(73) Assignee: Lin Kun Ta Industrial Co., Ltd., Changhua Hsien (TW)

( * ) Notice: Subject to any disclaimer, the term of this patent is extended or adjusted under 35 U.S.C. 154(b) by 0 days.

(21) Appl. No.: 11/195,806

(22) Filed: Aug. 3, 2005

(51) Int. Cl.
*A45C 3/00* (2006.01)

(52) U.S. Cl. ..... 16/444; 16/440; 16/422

(58) Field of Classification Search ..... 16/444, 16/435, 436, 440, 422; 248/205.1, 214, 231.91; 4/577.1, 576.1, 571.1, 511
See application file for complete search history.

(56) References Cited

U.S. PATENT DOCUMENTS

D67,601 S * 6/1925 Jordan ..... D6/533
2,242,461 A * 5/1941 Fisher ..... 4/576.1
4,162,544 A * 7/1979 Freeman et al. ..... 4/576.1
4,912,809 A * 4/1990 Scheuer ..... 16/413
6,726,161 B1 * 4/2004 Plump et al. ..... 248/205.1
2005/0160526 A1 * 7/2005 Korn ..... 4/577.1

* cited by examiner

*Primary Examiner*—Chuck Y. Mah
*Assistant Examiner*—Mark T. Vogelbacker
(74) *Attorney, Agent, or Firm*—Rabin & Berdo, P.C.

(57) ABSTRACT

A handle applied in bathroom and fixed on the wall. The handle is composed of a handhold pipe, a garnering rack, several supporting rods and covers, a middle positioning body and two side positioning bodies. The handle pipe is a hollow tube and holes sit at the middle and both ends respectively to match with middle positioning body, end positioning bodies and supporting rack tube holes separately. All holes will be bolted and be positioned; the other end will be bound to the positioning piece fixed on the wall and covered by cover which located on the supporting rack. Both ends of the garnering rack will be inserted into the hollow tubes of the end positioning bodies to be positioned and assembled. Hence, the whole assembling processes provide an easy, convenient, quick and time-saving effect and complete the purpose of fastness and safety to prevent loosen and fallen off.

3 Claims, 7 Drawing Sheets

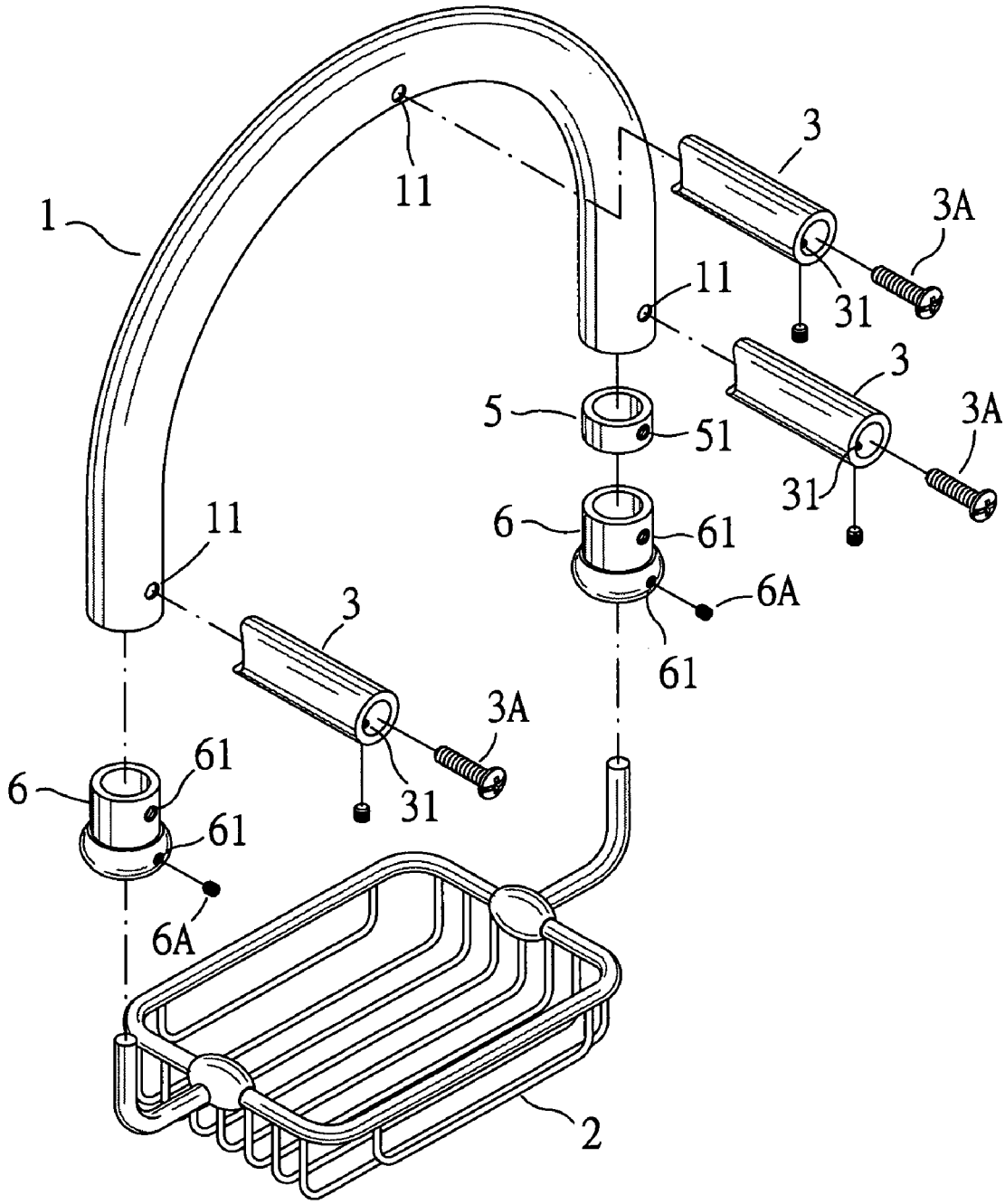
FIG. 1-A

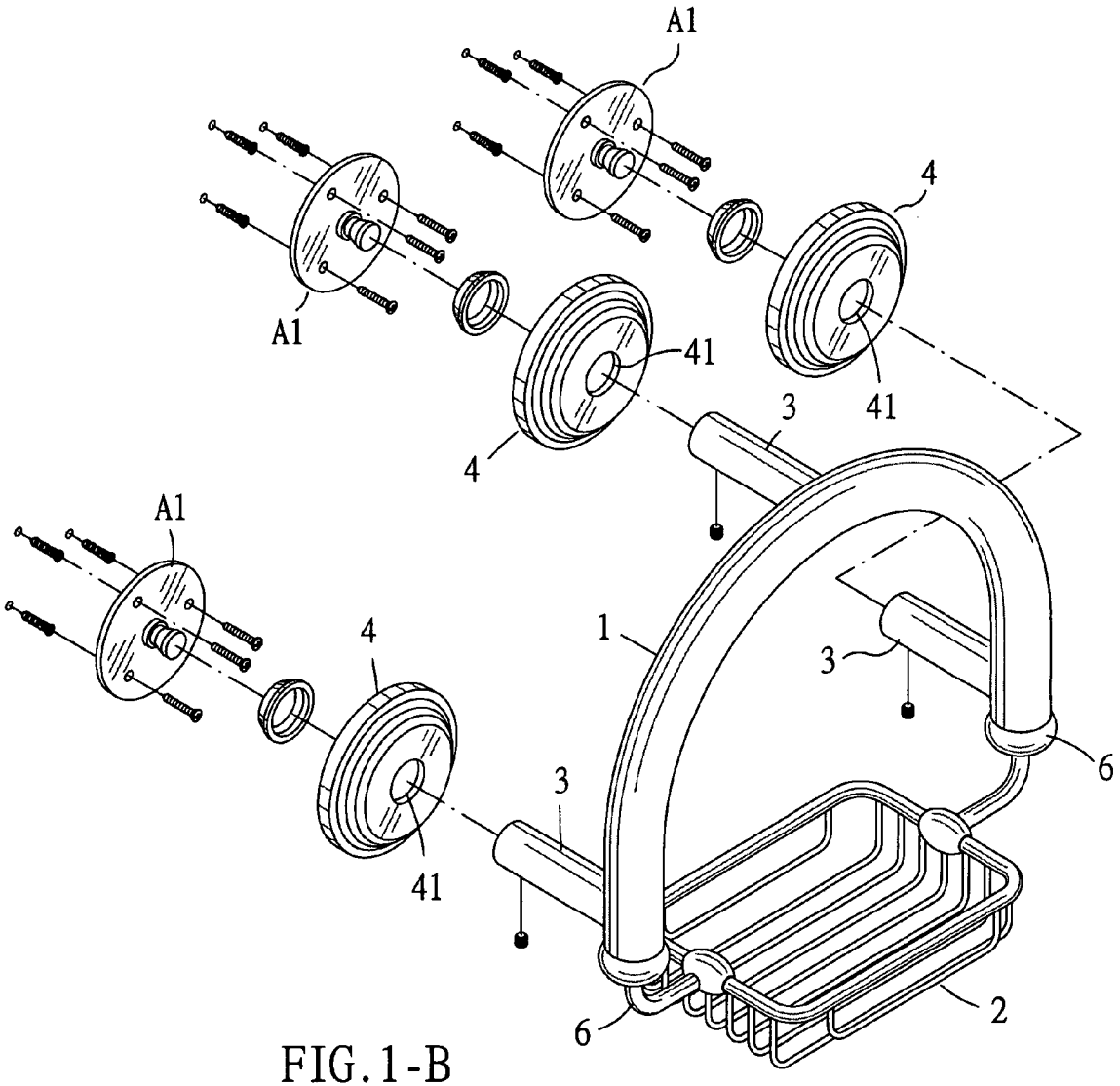
FIG. 1-B

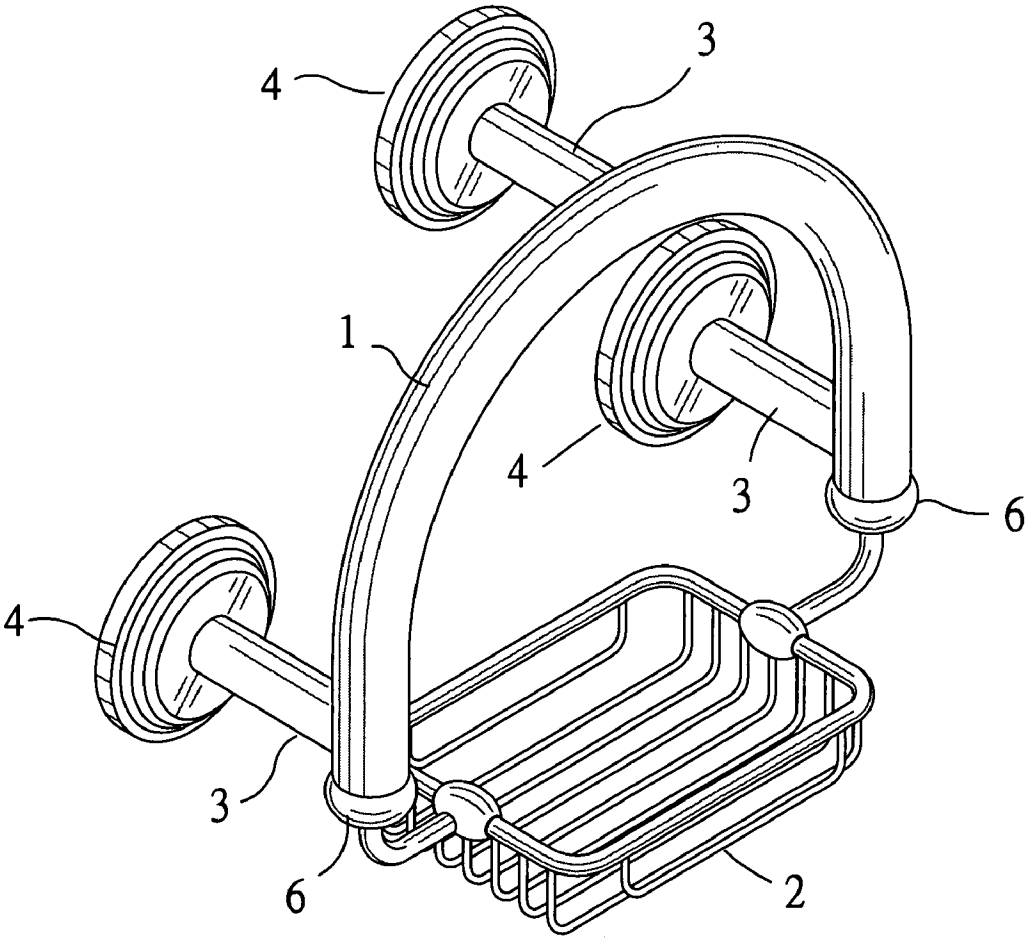
FIG. 2-A

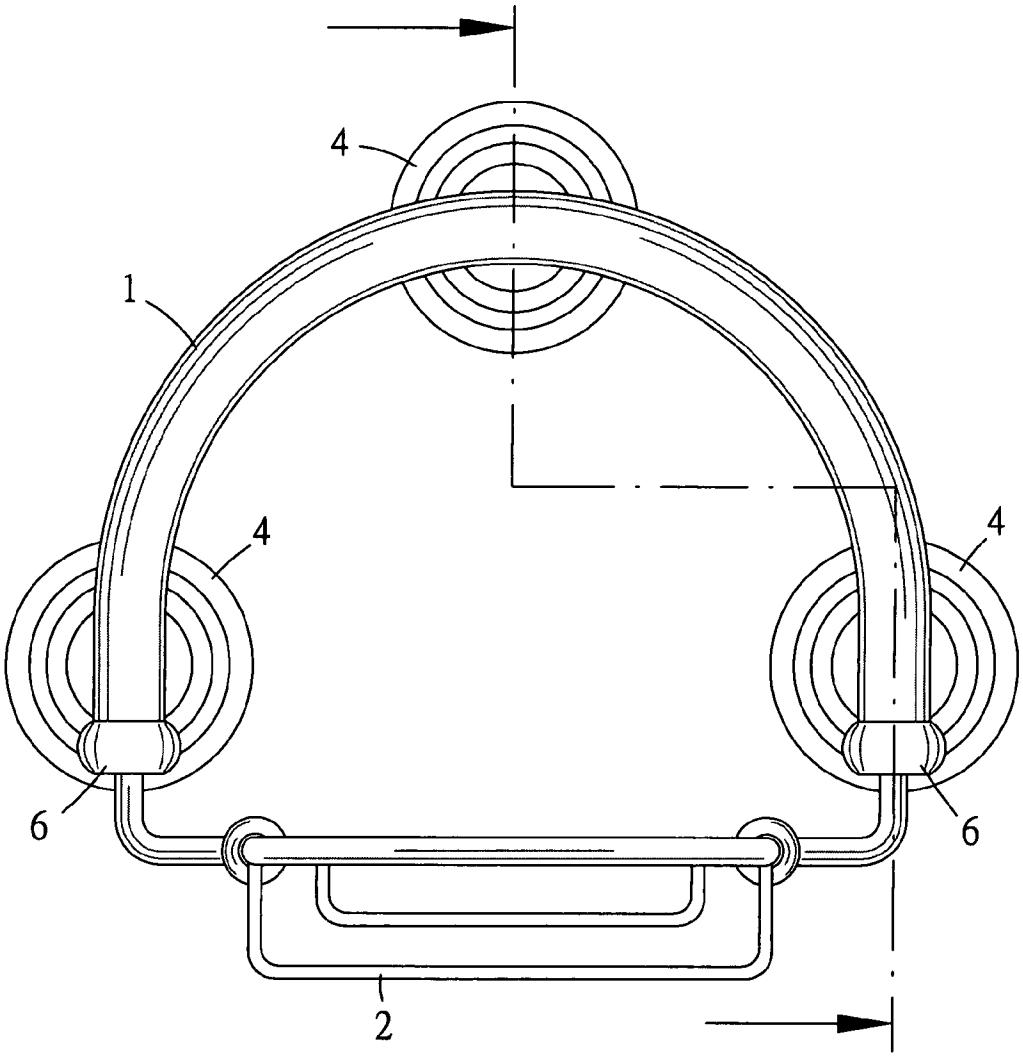
FIG. 2-B
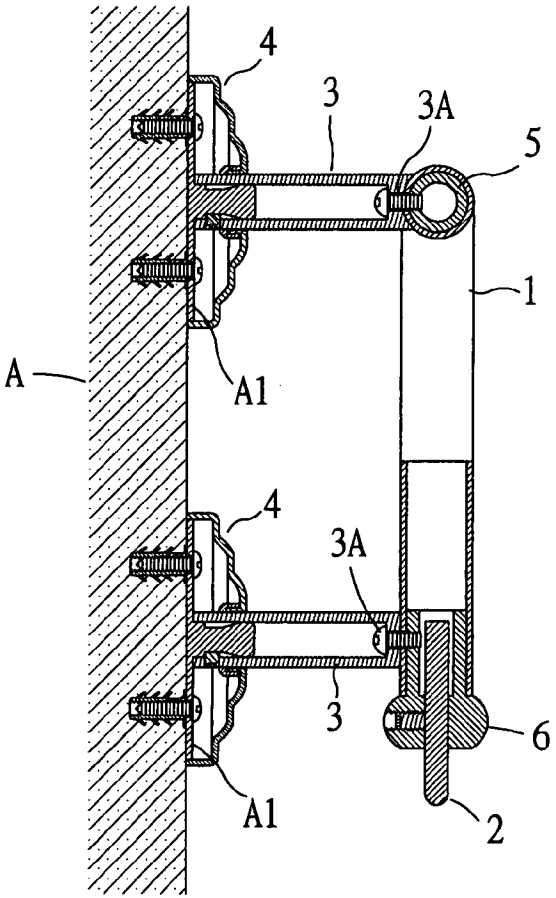
FIG. 2-C

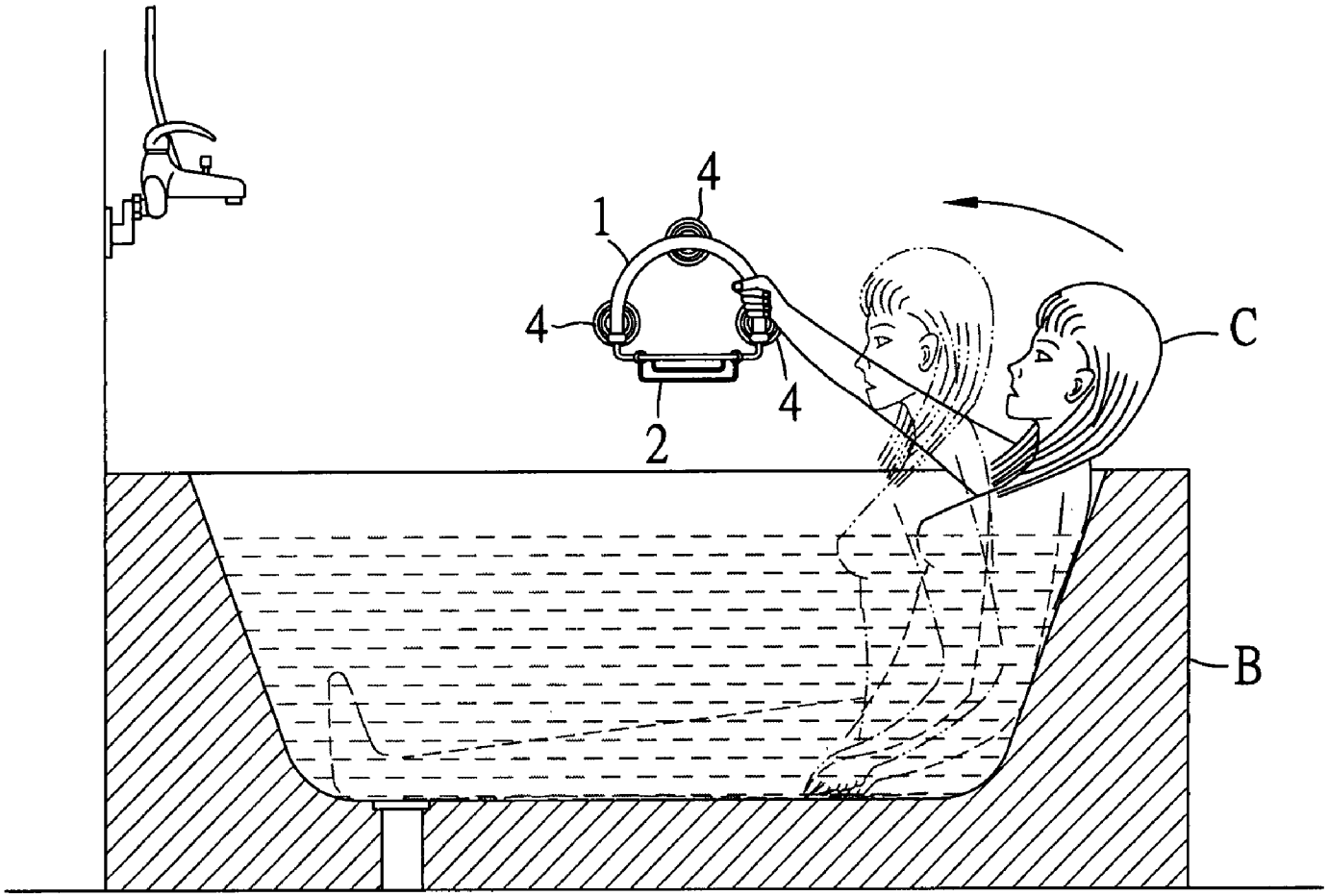
FIG. 3-A

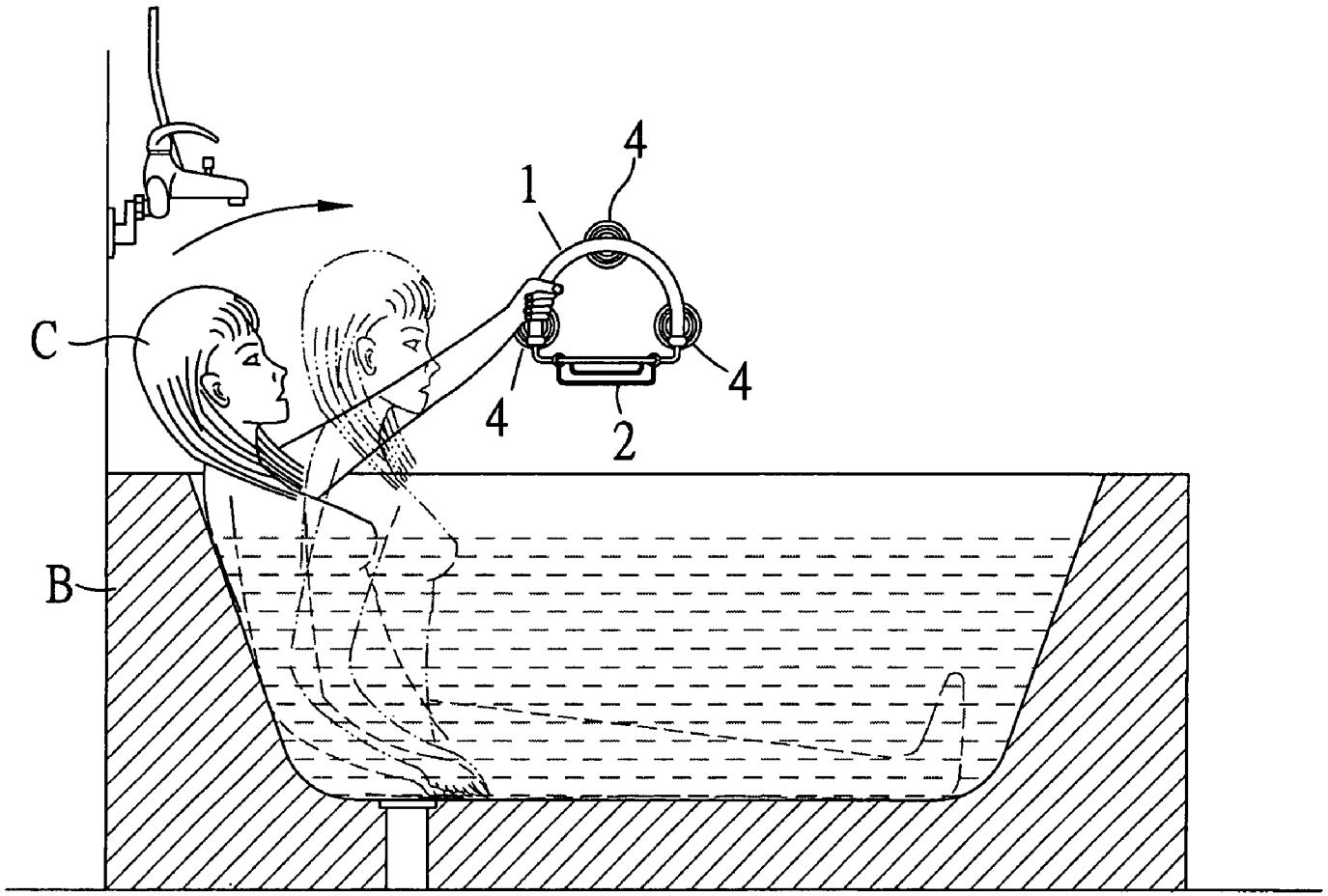
FIG. 3-B

HANDLE APPLIED IN BATHROOM

BACKGROUND OF THE INVENTION

1) Field of the Invention

This invention relates to a structure of the handle which is to provide an easy, convenient, fast and time-saving installment for the purpose of firmness and safety to prevent it from being loosened and shaken.

2) Description of the Prior Art

Normally, of handles in bathrooms are fixed by drilling several holes on the handle directly, then mounting several supporting rods at the opposition places and bolting with bolts. In such case, bolts determine whether the handle is fixed well enough on the wall. However, when the handle is fixed beside the tub, the purpose for installing the handle is to provide an assistant tool to help the user who is wet and slick to get up from the tub. Since every user has different weight, they will bring different forces on the handle. Consequently, if bolts can fix the handle on the wall well enough will be a concern. In addition, after long-time application, rust of the bolts will decrease the supporting force of the handle, and when fatter users bring stronger forces on it, accidents might happen. Besides, using bolts bolting bolted through the handle and locked on the supporting rack will spoil the aesthetics of the handle and decrease the quality; this will make people doubt its fastness.

DESCRIPTION OF THE INVENTION

The objective of this invention is to provide a structure of the handle applied in bathroom and fixed on the wall. The handle is composed of a handhold pipe, a garnering rack, several supporting rods and covers, a middle positioning body and two side positioning bodies. The handle pipe is an hollow tube and holes sit at the middle and both ends respectively to match with middle positioning body, end positioning bodies and supporting rack tube holes separately. All holes will be bolted with bolts and be positioned; then, the other end of the supporting rack will be bound to the positioning piece fixed on the wall and covered by cover which located on the supporting rack. Both ends of the garnering rack will be inserted into the hollow tubes of the end positioning bodies at both ends of the handle pipe to be positioned and assembled. Hence, the whole assembling processes provide an easy, convenient, quick and time-saving effect and complete the purpose of fastness and safety to prevent loosen and fallen off.

The other purpose of the invention is to provide a structure of the handle applied in bathroom, in which the appearance modeling of the handle pipe, garnering rack and cover can be modified for providing customers' multiple choice for installment.

BRIEF DESCRIPTION OF THE DRAWINGS

FIG. 1-A: a 3-D decomposed diagram of the structure of the invention.

FIG. 1-B: a 3-D diagram of the invention assembled on the wall.

FIG. 2-A: a 3-D diagram of the invention assembled.

FIG. 2-B: a plane diagram of the invention assembled.

FIG. 2-C: a section view of the invention assembled.

FIG. 3-A: the preferred embodiment diagram of the invention (I)

FIG. 3-B: the preferred embodiment diagram of the invention (II).

DETAILED DESCRIPTION OF THE PREFERRED EMBODIMENTS

Figure 4:
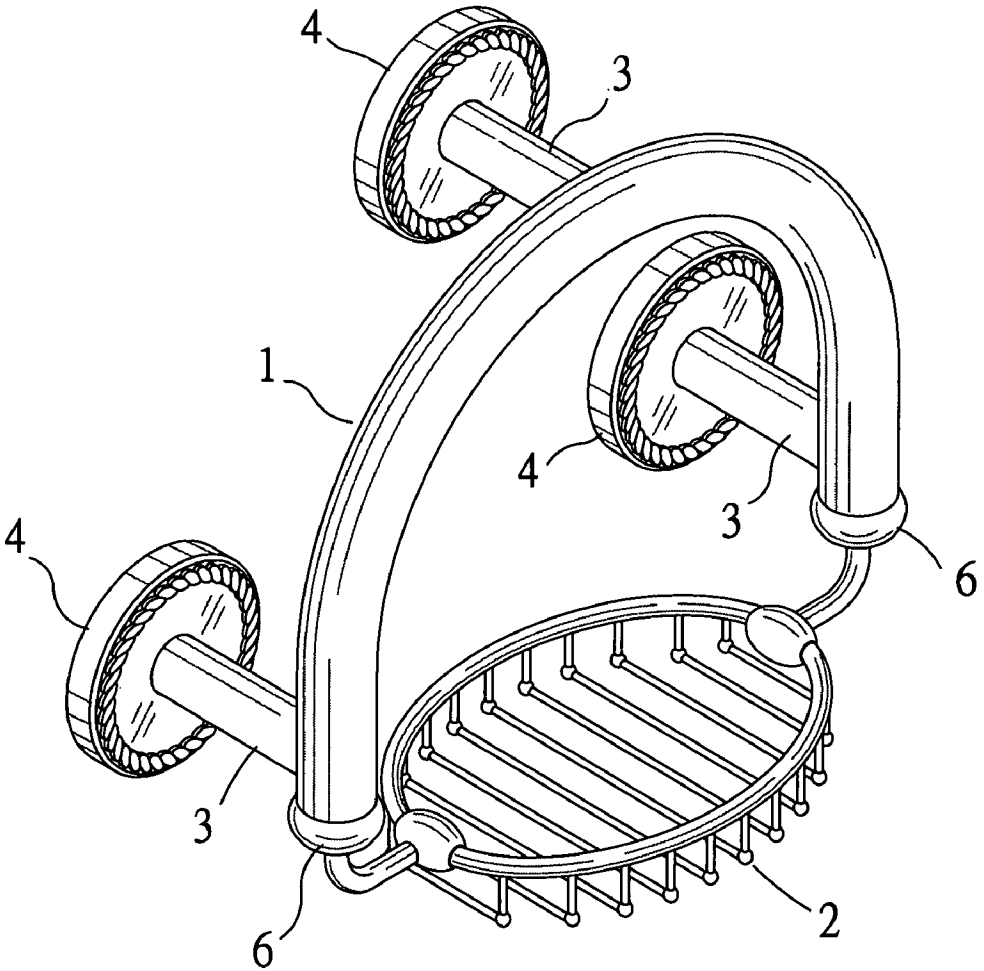
FIG. 4: the other preferred embodiment diagram of the invention.

Firstly, refer to the detail description of the FIG. 1-A and FIG. 1-B: a handle applied in bathroom of the invention is fixed on the bathroom wall. Major components are one handle pipe 1 for handhold, one garnering rack 2, several supporting rack 3 and covers 4, one middle positioning body 5 and two end positioning bodies 6. The handle pipe 1 is a hollow tube and penetrated holes 11 sit at the middle and both ends respectively. Garnering rack 2 is able to collect soap, sponge and body cleanser bottles. The form of the supporting rack 3 is a tube, and an end hole is sit at one end, while a thread hole 31 is located at the other end. Covers 4 are decorated with different pictures at its surface and a penetrated hole 41 sit at the middle part of it to bind to the supporting rack 3. The one middle positioning body 5 is situated at the middle part of the hollow tube—handle pipe 1, and the middle positioning body 5 is a ring and a thread hole 51 is at outer circle surface. The two end positioning bodies 6 are at the both ends of the hollow tube handle pipe 1, and there are two upper and lower different threaded holes 61 at the outer circle surface of the end positioning bodies. By placing the one middle positioning body 5 and two end positioning bodies 6 at the middle part and both ends of the handle pipe 1 and matching thread hole 51 and thread holes 61 with the penetrated holes 11 and then, overlapping with tube end holes of the supporting rack 3, and then, bolted by bolts 3 A to be positioned. Hence, assembling middle positioning body 5 and end positioning bodies 6 between handle pipe 1 and supporting rack 3 would strengthen the fastness of assemblage. It will not be as weak as traditional bolting connection only, but strong enough to resist the driving force of people's body weight. Obviously, it is very fast and safe in application. After that, the other end of the supporting rack 3 is connected with positioning piece A1 fixed on the wall surface A; then, covered by cover 4 on supporting rack 3 to embellish it. Both ends of the garnering rack 2 are placed into thread holes 61 sit at the lower edge of the hollow tube of the end positioning bodies 6 at both ends of the handle pipe 1; then, fixed by bolts 6A to be positioned and assembled, as shown in FIGS. 2-A, 2-B, 2-C. Therefore, the invention provides an easy, convenient, quick and time-saving installing processes. When installed beside tub B (as in FIGS. 3-A, 3-B), the invention can provide an assistant tool to help user C, who is wet and slippery, to get up by gripping the handle pipe 1.

Surely, the appearance of the handle pipe 1, garnering rack 2 and cover 4 can be modified (as in FIG. 4) to provide multiple choices for customers.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

The invention claimed is:

1. A handle adapted to be fixed on a wall of a bathroom, comprising:

a curve-shaped, hollow handle pipe that serves as a handhold, and having first, second and third holes that penetrate a wall of said handle pipe, said first and second holes being disposed at respective opposite ends of said handle pipe, said third hole being disposed at a middle of said handle pipe;

a ring-shaped, middle positioning body having a threaded hole, and being disposed within said handle pipe so that the threaded hole of said middle positioning body is in alignment with the third hole of said handle pipe;

two end positioning bodies, each having an upper threaded hole, and each being insertable within a respective end of said handle pipe so that the upper threaded hole of one of said end positioning bodies is in alignment with the first hole of said handle pipe, and the upper threaded hole of another of said end positioning bodies is in alignment with the second hole of said handle pipe;

a plurality of tubular supporting racks, each having a first end, and a second end;

a plurality of threaded fasteners, each having a shank and a head, each threaded fastener being insertable within a respective supporting rack by way of the second end, each first end of said supporting racks having an opening that is large enough to allow a respective shank, but not a corresponding head, to pass therethrough, said threaded fasteners being threadably enagegable with the respective threaded holes of the end and middle positioning bodies, to secure said supporting racks to said handle pipe;

a plurality of positioning pieces that are fixable to the wall, and to which the respective second ends of said supporting racks are connectable; and a plurality of decorative covers, each having a central hole that allows each cover to be sleeved over a respective supporting rack, and which cover the respective positioning pieces.

2. The handle recited in claim 1, wherein each of said end positioning bodies further has a lower threaded hole; further comprising a garnering rack adapted to hold articles and bottles, and having arms that are insertable into the respective end positioning bodies, the arms being secured therein using threaded fasteners that are engaged with the lower threaded holes of the respective end positioning bodies.

3. The handle recited in claim 1, wherein each supporting rack has a threaded hole disposed in a wall thereof and in a region of the second end, and wherein the positioning pieces are secured to the respective supporting racks using threaded fasteners that are engaged with the threaded holes of the respective supporting racks.

* * * * *